US010957165B2

(12) United States Patent
Dluzen et al.

(10) Patent No.: US 10,957,165 B2
(45) Date of Patent: Mar. 23, 2021

(54) CRANE GAME HAVING INTERNAL HOUSING UNIT

(71) Applicant: Innovative Concepts in Entretainment, Inc., Clarence, NY (US)

(72) Inventors: Ed Dluzen, Clarence, NY (US); John Mecca, Lockport, NY (US); Alex Wangler, Niagara Falls, NY (US)

(73) Assignee: Innovative Concepts in Entertainment, Inc., Clarence, NY (US)

( * ) Notice: Subject to any disclaimer, the term of this patent is extended or adjusted under 35 U.S.C. 154(b) by 0 days.

(21) Appl. No.: 16/665,297

(22) Filed: Oct. 28, 2019

(65) Prior Publication Data

US 2020/0134982 A1 Apr. 30, 2020

Related U.S. Application Data

(60) Provisional application No. 62/751,648, filed on Oct. 28, 2018.

(51) Int. Cl.
*A63F 9/30* (2006.01)
*G07F 17/32* (2006.01)

(52) U.S. Cl.
CPC ..... *G07F 17/3297* (2013.01); *A63F 9/30* (2013.01); *G07F 17/3251* (2013.01); *A63F 2250/144* (2013.01); *G07F 17/323* (2013.01); *G07F 17/3246* (2013.01); *G07F 17/3248* (2013.01)

(58) Field of Classification Search
CPC .... A63F 9/30; A63F 2250/144; G07F 17/323; G07F 17/3246; G07F 17/3248; G07F 17/3251; G07F 17/3297
See application file for complete search history.

(56) References Cited

U.S. PATENT DOCUMENTS

2003/0090065 A1* 5/2003 Carter, Jr. ..... A63F 9/30 273/447
2007/0114725 A1* 5/2007 Peck ..... G07F 17/3295 273/447
2012/0025469 A1* 2/2012 Shiino ..... G07F 17/3253 273/447
2012/0056381 A1* 3/2012 Shiino ..... A63F 9/30 273/448
2014/0274312 A1* 9/2014 Walters, Jr. ..... G07F 17/3248 463/25

(Continued)

*Primary Examiner* — Raleigh W Chiu
(74) *Attorney, Agent, or Firm* — Stadler IP Law PLLC

(57) ABSTRACT

A crane game is provided with a gantry supporting a claw mechanism for grabbing bundles of tickets having RFID tags. A solid playing floor supports the bundles of tickets. An internal housing unit is supported on the playing floor and defines a prize chute. A claw mechanism grabs a bundle of tickets. The claw mechanism is lowered into the internal housing unit where a shielded RFID reader reads the RFID tag of the bundle of tickets. The internal housing unit has internal first, second, and third deflection walls that meet with one another at a peak and they slope in a direction towards the playing floor. If a bundle of tickets falls out of the claw mechanism while it is in the internal housing unit, then the bundle of tickets hit one of the first, second, or third deflection walls and exits through first, second, or third internal housing unit exits.

14 Claims, 3 Drawing Sheets

(56) References Cited

U.S. PATENT DOCUMENTS

| | | | | |
|---|---|---|---|---|
| 2018/0137718 | A1* | 5/2018 | Smart | A63F 9/24 |
| 2019/0251795 | A1* | 8/2019 | Smart | G07F 17/3248 |
| 2020/0126366 | A1* | 4/2020 | Smart | G07F 17/3216 |
| 2020/0134982 | A1* | 4/2020 | Dluzen | G07F 17/3251 |

* cited by examiner

CRANE GAME HAVING INTERNAL HOUSING UNIT

CROSS-REFERENCE TO RELATED APPLICATIONS

This application is a Nonprovisional application of U.S. Provisional Application No. 62/751,648, filed Oct. 28, 2018, the disclosure of which is incorporated herein by reference.

FIELD OF INVENTION

This invention is directed to an arcade game. More specifically, this invention relates to a crane game.

BACKGROUND OF INVENTION

Many people enjoy visiting entertainment centers that have arcade games and, in particular, crane games. Entertainment centers are currently expanding across the country because many of these businesses not only offer amusement games, but also offer food and beverages. This makes entertainment centers suitable for hosting parties, birthday parties, graduation parties, and business parties for adults. While the children play, the parents can also play games, eat, or socialize. Entertainment centers have traditional games such as pinball and have many other arcade games and crane games.

Players, especially children, enjoy going to these entertainment centers so they can play traditional games such as pinball games and so they can play skill games where the player directly interacts with the game. For example, there are crane games equipped with joysticks and buttons. The crane game has a claw that the player can move along a gantry in the X-axis and the Y-axis directions. Once at a desired location, the player can press a button and drop the claw causing the claw to fall in the direction of the Z-axis. Traditionally, crane games were filled with a number of different prizes. In order to win a prize, the player would manipulate the crane over the desired prize within the game playing floor and deploy the crane to try to grab the prize. If the crane successfully picked up the prize, the prize would be dispensed to the player through a chute leading to the outside of the game.

More recently, developments in the arcade gaming industry have led to changes in how prizes are managed and the types of prizes included in many arcades. One common arrangement is for players to be awarded tickets by various games within an arcade. A player can accumulate tickets from many different arcade games and then redeem the tickets for a variety of prizes that are assigned ticket values. For this reason, crane games have been developed where the prizes, such as toys and novelty items have been replaced by bundles of tickets or other physical items that are marked with a ticket value.

Crane games have an electronic control system and a mechanical system that allows a player to purchase a chance to win a bundle of tickets by skillful manipulation of player controls. The controls include a joystick and/or buttons. These controls allow the player to move a motor-operated crane head in front/back (X-axis) and left/right (Y-axis) directions above a supply of bundle of tickets and then drop a claw which will pick up a bundle of tickets if skillfully and properly manipulated. When the claw drops to the bottom of its travel, the electronic control system closes the claw. The closing of the claw may grasp one or more bundle of tickets, or may remain empty. The control system then raises the claw, positions it over a delivery chute and releases any bundle of tickets held by the claw.

An additional development has been the addition of an RFID tag to the bundle of tickets. In this way, the bundle of tickets does not need to be handled by the user or player. Rather, the ticket value can be included on the particular RFID tag and then an RFID reader scans the RFID tag associated with a particular bundle of tickets.

Upon coming into contact with a bundle of tickets that have RFID tags, the claw closes on the bundle of tickets. After the claw closes it moves vertically upward in the direction of the Z-axis. Then the claw moves horizontally in the direction of the X-axis and Y-axis until it is positioned over a chute. The chute leads to an opening defined in the floor of the game. The claw opens and if there are any bundles of tickets in the claw they fall out of the claw. The opening in the floor of the game has an RFID reader. If the RFID reader detects a bundle(s) of tickets as it moves through the opening in the floor, then the player wins the number of tickets associated with the RFID tag. The game dispenses the number of tickets won to the player. The tickets are paper and there is a redemption counter where the player can trade the tickets for a prize, for example a stuffed animal. Thus, from the player's point of view the tickets are a form of money. Alternatively, the number of tickets may be written onto a game card. Each player has his or her own game card and it includes information about how many credits the player has for playing games and information about how many tickets the player has won. The ticket value on the card can be turned in for actual prizes.

Unfortunately, the crane games that lift, move, and drop the bundles of tickets with RFID tags are not without problems. When the bundles of tickets with RFID tags fall out of the claw, they are read by an RFID reader and then fall in a basket that is positioned below the playing floor of the game. The bundles of tickets stack up on top of one another and over time the entertainment center must have a worker empty the basket. If this is not done, then the game may run out of bundles of tickets for the players to grab and the bundles of tickets may start overflowing from the basket. It is also possible that the bundles of tickets may fall into the internal workings of the crane game and cause damage to the internal components.

Thus, there is a need for an improved crane game that eliminates the need for baskets for collecting bundles of tickets and eliminates the time wasted emptying baskets filled with bundles of tickets.

SUMMARY OF THE INVENTION

Accordingly, it is the subject of this invention to provide a crane game that eliminates the need for baskets. A crane game is provided that has a gantry for supporting a crane that supports a claw mechanism that is capable of grabbing bundles of tickets having RFID tags. The crane game has a playing floor that supports the bundles of tickets and an internal housing unit that is supported on the playing floor. A player controls the game and uses a claw mechanism to grab bundles of tickets. After the attempt, the claw mechanism is raised up and moves over an internal housing unit supported on the playing floor. There are no openings in the playing floor. The internal housing unit has a generally rectangular shape and defines a prize chute opening and the claw mechanism is lowered into the internal housing unit through the prize chute. Of note, the prize chute is completely internal to the crane game and does not allow the bundles of tickets to leave the crane game or the playing floor. Positioned in the internal housing unit is a shielded RFID reader and antennae that is capable of reading bundles of tickets and unaligned bundles and reads these bundles of tickets. The claw mechanism then drops the bundles of tickets through the prize chute and the bundles of tickets hits a prize deflector. The claw mechanism is then raised and moved over a random position of the playing field and is ready for further game play.

The internal housing unit has fitted therein first, second, and third deflection walls that meet with one another at a peak forming a ramp shape. All of the deflection walls slope in the direction towards the playing floor. If and when a bundle of tickets falls out of the claw mechanism while the claw mechanism is positioned over the prize chute or is in the internal housing unit, then the bundles of tickets fall and hit one of the deflection walls. The player is still credited with a win if this happens. The walls extend to first, second, and third internal housing unit exits defined in the internal housing unit. Once a bundle of tickets exits through any of the internal housing unit exits, then gravity causes it to randomly fall onto the playing floor where the players can try to grab that bundle of tickets or any other bundle of tickets on the playing floor.

The crane game also includes an internal display that informs the player of the wins, losses, and other game data.

DETAILED DESCRIPTION OF THE INVENTION

Components List

Figure 1:
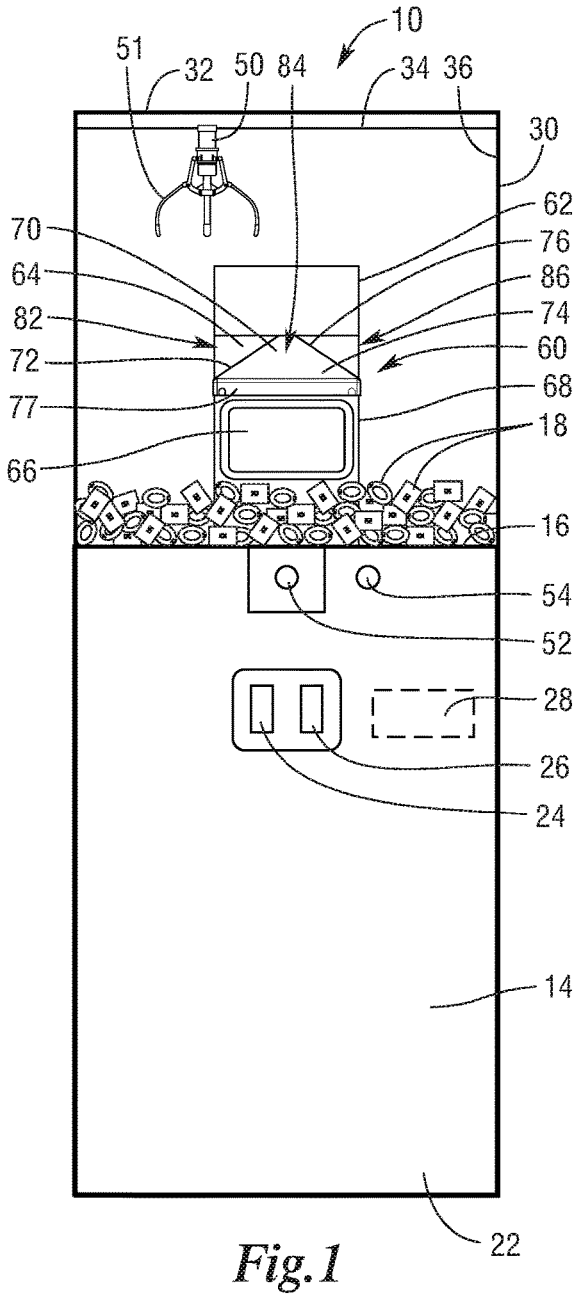
FIG. 1 is front view of a crane game having an internal housing unit.
Figure 2:
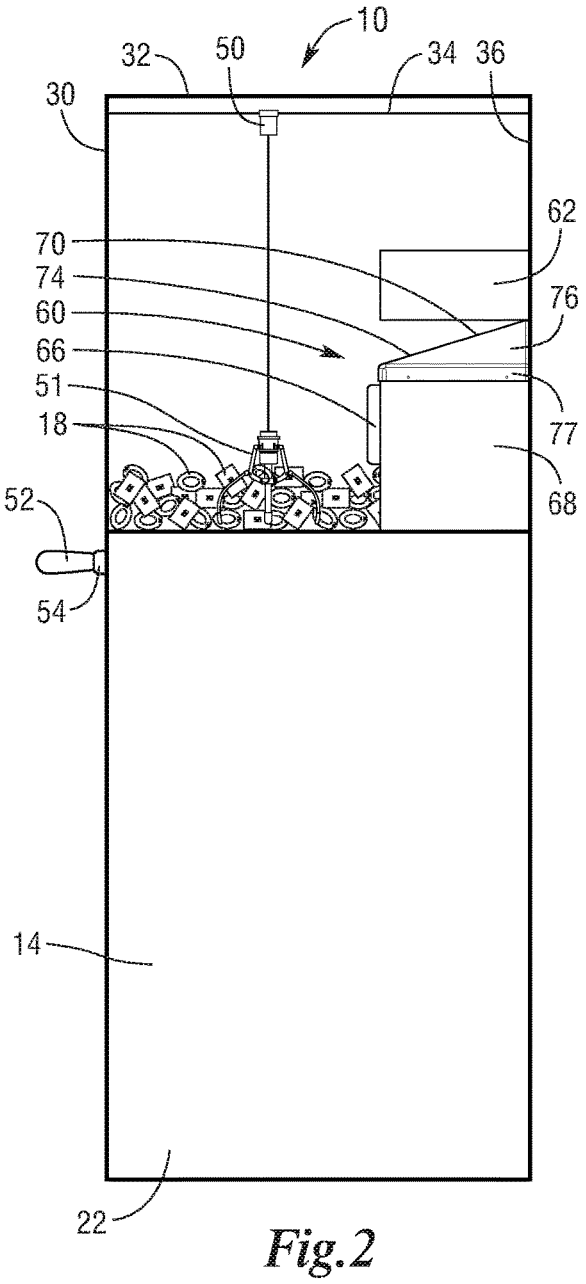
FIG. 2 is a right side view of a crane game having an internal housing unit.
Figure 6:
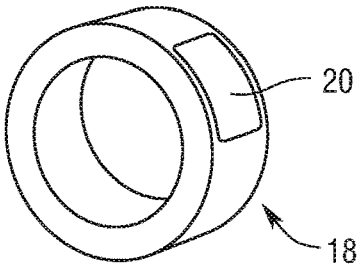
FIG. 6 is front view of the bundle of tickets.

Crane game—10
Game housing—14
Playing floor—16
Bundle of Tickets—18
RFID tags—20
Electronics—22
Coin or game card slot—24
Ticket dispenser—26
Tickets—28
Crane housing—30
Ceiling—32
Gantry—34
Rear wall—36
Crane—50
Claw mechanism—51
Joystick—52
Button—54
Internal housing unit—60
Prize chute—62
Support—64
Display—66
Internal housing unit base—68
Prize deflector—70
Peak—71
First deflection wall—72
Second deflection wall—74
Third deflection wall—76
Front deflector support—77
Left front deflector support groove—77*a*
Right front deflector support groove—77*b*
Side deflector support—78
Side deflector support groove—78*a*
Side deflector support opening—79
Shielded RFID reader and antennae—80
First internal housing unit exit—82
Second internal housing unit exit—84
Third internal housing unit exit—86
First side—$S_1$
Second side—$S_2$
Third side—$S_3$
Fourth side—$S_4$
Hypotenuse side—$H_1$
Adjacent side—$A_1$
Opposite side—$O_1$ FIGS. 1 and 2 show front and side views of a crane game 10, which has a game housing 14 that supports a playing floor 16. The playing floor 16 supports bundles of tickets 18. As shown in FIG. 6 bundle of tickets 18 has an RFID tag 20. The playing floor 16 does not have any openings, thus bundles of tickets 18 are not able to pass through the playing floor 16. Positioned internal to the game housing 14 are game electronics 22, and the game housing 14 defines coin or game card slots 24. Players (not shown) can insert coins or tokens or a game card into the coin or game card slot 24 to activate the crane game 10 allowing the player to play the crane game 10. The game housing 14 also is loaded with winner tickets 28, such that when the player wins a bundle of tickets 18, the equivalent number of tickets 28 can exit the crane game 10 through a ticket dispenser opening 26. In the embodiment that uses a game card, the game card stores wins on the game card, thereby eliminating the need for tickets 28 and ticket dispenser 26. In this embodiment, the coin or game card slot 24 is used for inserting the game card instead of coins. The game card includes information about tickets wins and the balance of game credits. The player may add money to the game card in order to continue playing. When the player is done playing, the player may cash in ticket wins for actual prizes. The electronics used in connection with crane games and the control of the cranes in such games is known to those skilled in the art.

The crane game 10 also has a crane housing 30 that is enclosed within game housing 14 and that is positioned towards the top of the game housing 14 such that it is at eye level for a player. The crane housing 30 does not move during game play. As shown in FIGS. 1 and 2, the crane housing 30 has a rectangular shape in one embodiment and prevents the bundles of tickets 18 from falling out of the crane game 10. The outside of the crane housing 30 is made of a clear material, for example plastic or glass, so that players can look inside of the crane housing 30 and the bundles of tickets 18 supported on the playing floor 16. The crane housing has a ceiling 32, best shown in FIGS. 1 and 2.

The ceiling 32 supports a gantry 34 as shown in FIGS. 1 and 2. The gantry 34 has a pair of first and second parallel rails (not shown) that are fixed in position relative to the crane housing 30. The gantry 34 also has a movable cross rail (not shown) having first and second movable cross rail ends (not shown). The first and second movable cross rail ends are supported on the first and second parallel rails respectively. Thus, the movable cross rail can be driven back and forth along the first and second parallel rails with, for example, motors and servomotors. A claw mechanism 51 having claws is supported by and hangs from the movable cross rail and the claw mechanism 51 can be raised and lowered relative to the playing floor 16 by a player, and the claw mechanism can be moved back and forth along the movable cross rail. Thus the claw mechanism 51 can be moved by the player in the X axis and the Y axis and the Z axis as shown in FIG. 2 by moving a joystick 52 shown in FIGS. 1 and 2. The joystick 52 is located on the external side of game housing 14. The joystick 52 is connected to the claw mechanism 51 and it allows the player to operate the position of the claw mechanism 51 above the playing floor 16. The player uses joystick 52 to try to capture a bundle of tickets 18.

After the player has moved the claw mechanism 51 over the desired bundles of tickets 18 he or she can push a drop button 54 that causes the claw mechanism 51 to drop and automatically close on the bundles of ticket 18 and at a first clamping force. The claw mechanism 51 is operated by a solenoid. Next, the claw mechanism 51 rises in the direction of the Z-axis and the claw mechanism 51 exerts a second clamping force that is less than the first clamping force. During these movements of the claw mechanism 51 the bundles of tickets 18 may fall out of the claw mechanism 51. If these bundles of tickets 18 fall onto the playing floor 16, then the player is not credited with a win. Claw mechanisms and their operation in crane games is known to those skilled in the art.

Figure 3:
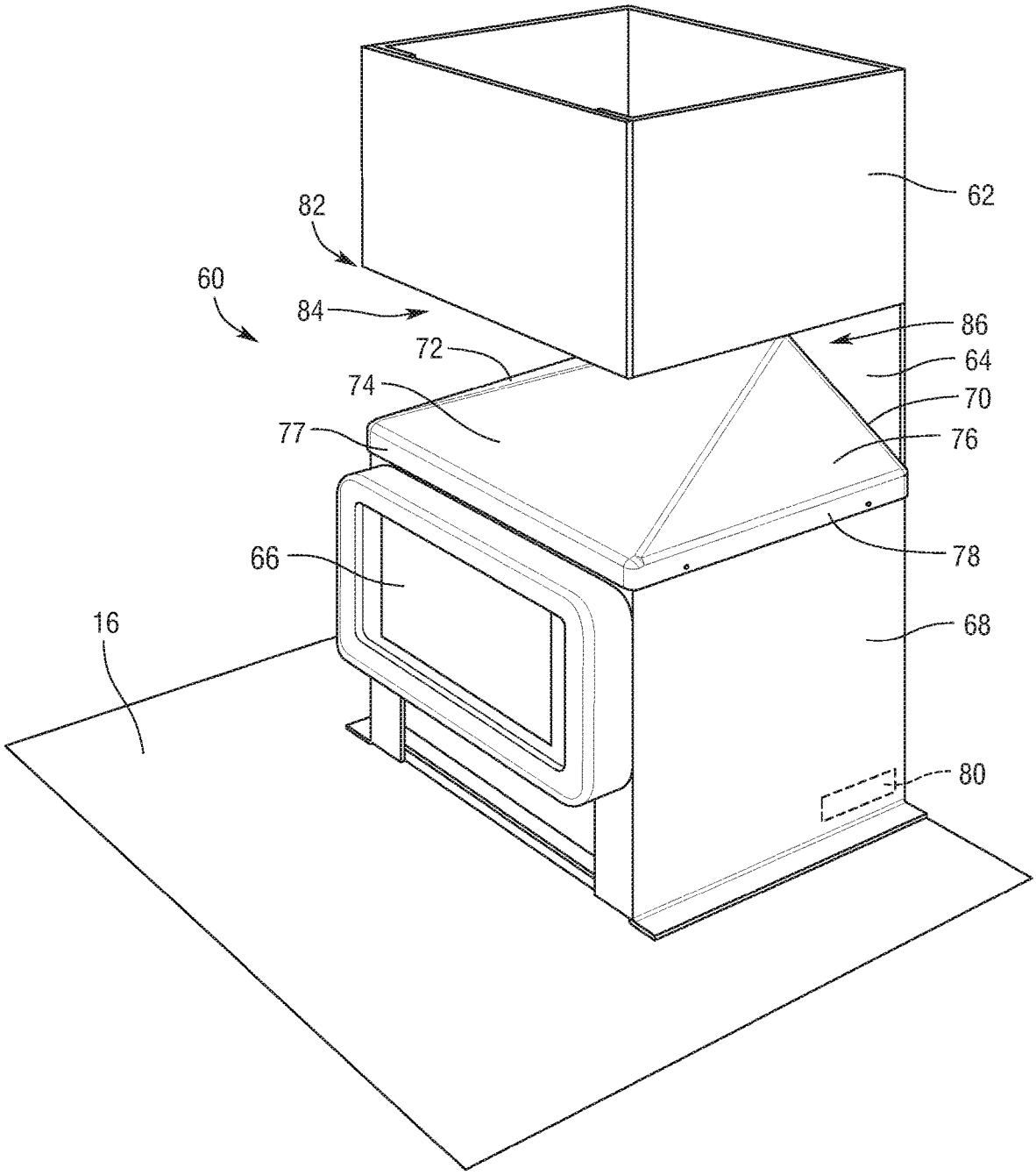
FIG. 3 is a perspective view of the internal housing unit of a crane game on the playing floor.

The crane game 10 also includes an internal housing unit 60 that is positioned in the crane housing 30 and supported on the playing floor 16 such that it cannot move. In one embodiment, there are no openings in the playing floor 16 associated with the internal housing unit 60. The internal housing unit 60 has a generally rectangular shape and abuts a rear wall 36 of the crane housing 30. The internal housing unit 60 defines a prize chute 62 and the claw mechanism 51 can be lowered into the internal housing unit 60 through the prize chute 62. Positioned in the internal housing unit 60 is a shielded RFID reader and antennae 80. In one embodiment, the RFID reader is a 900 MHz long distance reader such that unaligned and multiple bundles of tickets 18 can be read without the assistance of a worker. An RFID reader 80, best shown in FIG. 3, is located in the internal housing unit base 68 of internal housing unit 60 and is thusly shielded from the inadvertent reading of RFID tags 20. That is, the claw mechanism 51 in combination with bundles of tickets 18 and RFID tags 20 must be located in a particular location in order for the RFID reader 80 to be able to read the RFID tag 20. In particular, the claw mechanism 51 in combination with bundles of tickets 18 and RFID tag 20 must be located within the prize chute 62 of internal housing unit 60.

Figure 4:
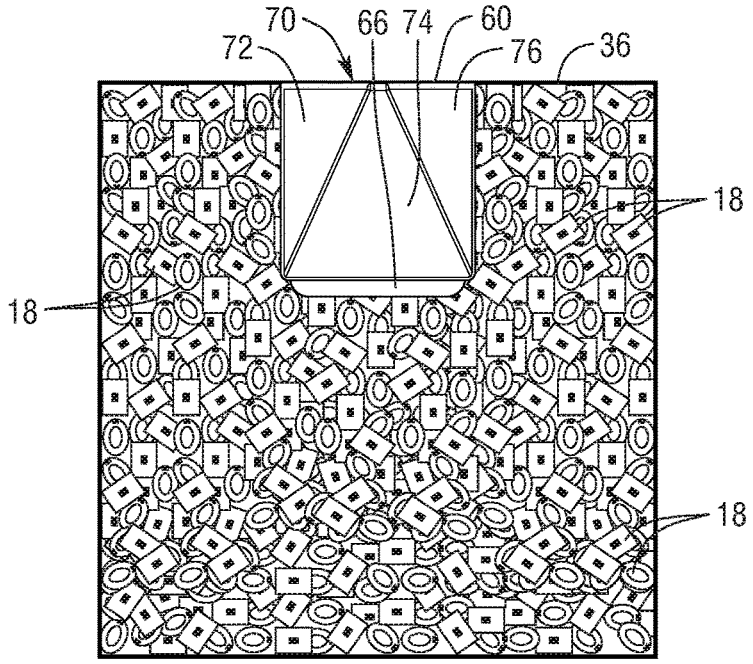
FIG. 4 is a top view of the internal housing unit of the crane game wherein the ceiling is not shown.

As shown in FIG. 3, the internal housing unit 60 has fitted therein first, second, and third deflection walls 72, 74, 76, that meet with one another at a peak 71 (shown in FIG. 4). All of the first, second, and third deflection walls 72, 74, 76, slope in a direction towards the playing floor 16. If and when a bundle of tickets 18 falls out of the claw mechanism 51 (as depicted in FIGS. 1 and 2) while the claw mechanism 51 is positioned over the prize chute 62 or is otherwise in the internal housing unit 60, the bundles of tickets 18 fall and hit either of the first, second, or third deflection walls 72, 74, 76. The player is credited with a win if this happens. The first, second, and third deflection walls 72, 74, 76, extend to first, second, and third internal housing unit exits 82, 84, 86, respectively, defined in the internal housing unit 60. If a bundle of tickets 18 exits through any of the first, second, third internal housing unit exits 82, 84, 86, then gravity causes it to fall onto the playing floor 16. Another player can then immediately try to retrieve that same bundle of tickets 18.

The crane game 10 also includes a display 66 that is connected to the base 68 of internal housing unit 60. Display 66 informs the player of the win and how many tickets have been won. In one embodiment, display 66 is an LED panel.

FIG. 4 is a top view of crane game 10 depicting the bundles of tickets 18 and a portion of the internal housing unit 60. For clarity, prize chute 62 is not shown. First, second, and third deflection walls 72, 24, and 76 are depicted. Display 66 is also shown.

Figure 5:
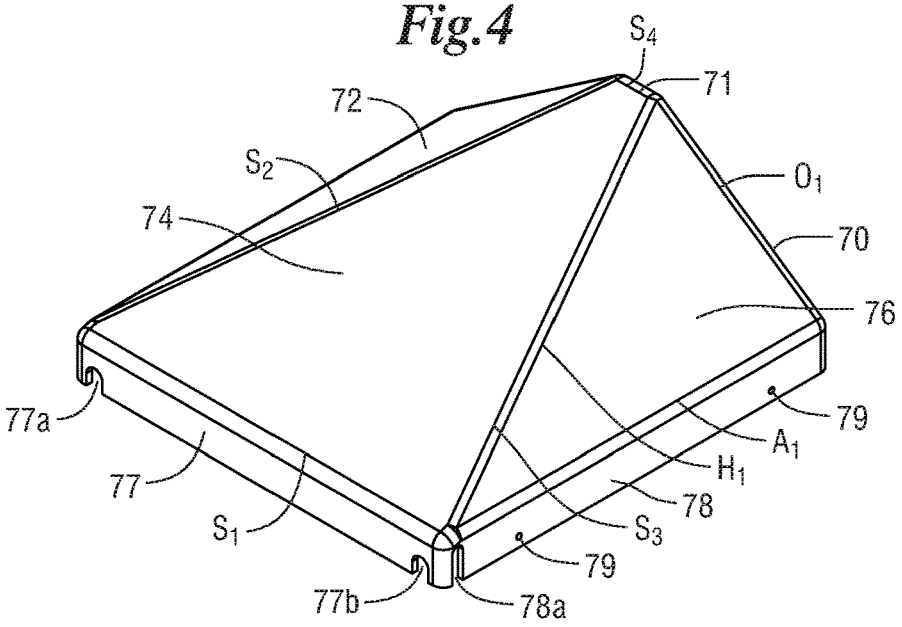
FIG. 5 is a perspective view of a prize deflector of the internal housing unit of the crane game.

FIG. 5 is a perspective view of the prize deflector 70 comprised of one trapezoid-shaped piece, second deflection wall 74, and two triangle-shaped pieces, first and third deflection walls 72, 76. First deflection wall 72 and third deflector wall 76 are mirror images of each other and both are connected to second deflection wall 74. Third deflection wall 76 is in the shape of a right triangle having three sides, hypotenuse side $H_1$, opposite side $O_1$, and adjacent side $A_1$. First deflection wall 72 is identical to third deflection wall 76. Second deflection 74 is in the shape of a trapezoid having first, second, third, and fourth sides $S_1$, $S_2$, $S_3$, and $S_4$. Second side $S_2$ and third side $S_3$ of second deflection wall 74 each abut hypotenuse side $H_1$ of third deflection wall 76 and hypotenuse side $H_1$ of first deflection wall 72, respectively. Opposite sides $O_1$ of first and third deflector walls 72 and 76 meet fourth side $S_4$ of second deflection wall 74 at peak 71 forming a ramp. All of the deflection walls slope down towards playing floor 16. When a bundle of tickets 18 hits any part of the prize deflector 70, it will bounce off of one of the deflection walls 72, 74, 76, and exit the internal housing unit 60 by way of first, second, or third internal housing unit exits 82, 84, 86, back onto the playing floor 16. The particular arrangement shown in FIG. 5 allows the bundles of tickets 18 to be randomly distributed on the playing floor 16.

As assembled, prize deflector 70 also includes front deflector support 77 and side deflector support 78. First and second deflection walls 72 and 76 are both connected to side deflector support 78 along their adjacent sides $A_1$. Side deflector support 78 is connected to internal housing unit base 68 by connectors (not shown) that are placed in side deflector support openings 79. Side deflector support 78 also includes side deflector support groove **78*a*, which allows side deflector support 78 to be inserted over the front wall (not shown) of internal housing unit base 68 such that the side walls (not shown) of internal housing unit base 68 are on the outside of side deflector support 78. Front deflector support 77 is connected to second deflection wall 74 along its first side $S_1$. Front deflector support 77 also includes left and right front deflector support grooves 77*a*, 77*b*, that allow front deflector support 77 to be connected to internal housing unit base 68 and display 66. For example, connectors may be inserted through left and right front deflector grooves 77*a*, 77*b*, to connect front deflector support 77 to internal housing unit base 68 and display 66**.

Although prize deflector 70 has been described above with two triangle-shaped pieces and one trapezoid-shaped piece, it is understood that prize deflector 70 could be made with a different number of pieces. For example, there may be two deflection walls instead of three, whereby the two deflection walls meet along an extended peak rather than the arrangement shown above in FIG. 5. In other embodiments, the first and second deflection walls are not right triangles.

In a preferred embodiment, the prize deflector 70 is made of acrylic and in a more preferred embodiment, the prize deflector 70 is made of translucent white acrylic. The translucent white acrylic allows RFID reader 80 to accurately read the RFID tag 20 of bundles of tickets 18.

FIG. 6 depicts bundle of tickets 18 in combination with RFID tag 20. Although the present disclosure has been described using bundles of tickets 18 it is understood that the bundle of tickets 18 could be any other prize.

The present invention provides many advantages. As described above, the need for collecting baskets filled with bundles of tickets and all of the problems associated therewith are eliminated by the crane game 10 described and shown herein. The internal housing unit 60 of the present invention allows the crane game 10 to be played without the interference of a worker to remove the bundles of tickets 18. The prize deflector 70 allows the RFID tag 20 to be read while the bundle of tickets 18 is located above in the prize chute 62. The prize deflector 70 also ensures that the bundle of tickets 18 is randomly distributed back onto the playing floor 16 once it is dropped from the claw mechanism 51. The present invention also allows for a playing floor 16 that is solid and thus does not have any openings in it. Thus a simplified playing floor 16 is provided.

EXAMPLES

Example 1

In one embodiment, the prize deflector 70 is assembled using three walls that peak towards the rear of the prize deflector 70 similar to a ramp. In this embodiment, the prize deflector 70 is placed on top of the internal housing unit base 68. The front and back of the internal housing unit base 68 is 7.75 inches in width and the two sides of the internal housing unit base 68 are 9.235 inches in length and the height of the front, back, and two sides of internal h sousing unit base 68 is 6 inches. In other embodiments, the height may be more or less than 6 inches. The width of the sides of internal housing unit base 68 is 0.375 inches. In this example, first side $S_1$ of second deflection wall 74 and front deflector support 77 are 8.84 inches. The distance between the two side deflection wall supports 79 is 6.0 inches. The height of the ramp created by prize deflector 70 is 3.448 inches, which includes the height of the front and side deflector supports 77, 78.

In one example, the angle between $H_1$ and $A_1$ is 17° and the angle between $H_1$ and $O_1$ is 73°. The angle between $O_1$ and $A_1$ is 90°. The angle between $S_2$ and $S_1$ and $S_3$ and $S_1$ is 55.5° and the angle between $S_2$ and $S_4$ and $S_3$ and $S_4$ is 124.5°.

It will be appreciated by those skilled in the art that while the crane game with internal housing unit has been described in detail herein, the invention is not necessarily so limited and other examples, embodiments, uses, modifications, and departures from the embodiments, examples, uses, and modifications may be made without departing from the process and all such embodiments are intended to be within the scope and spirit of the appended claims.

What is claimed is:

1. A crane game comprising:
- a game housing;
- an enclosed crane housing positioned within the game housing;
- a playing floor within the crane housing;
- a crane house ceiling;
- a gantry attached to the crane house ceiling;
- a crane attached to the gantry;
- a claw mechanism attached to the crane;
- at least one prize on the game playing floor;
- an RFID tag attached to the at least one prize;
- a joystick, wherein the joystick is located on an external side of the game housing;
- an RFID reader;
- a prize chute;
- a prize deflector, wherein the prize deflector includes first, second, and third deflection walls;
- a base; and
- an internal housing unit supported on the playing floor, wherein the internal housing unit further comprises a support and wherein the prize chute is located at the top of the support, the base is located at the bottom of the support, the prize deflector sits on top of the base, and the RFID reader is located within the prize chute.

2. The crane game of claim 1, wherein the shape of the prize chute is either square or rectangular.

3. The crane game of claim 2, wherein the base has a bottom, a front, a back, and two sides and is in the shape of a square or a rectangular.

4. The crane game of claim 3, wherein the base also has a display.

5. The crane game of claim 1, wherein the shapes of the first and third deflection walls are identical and are in the shape of a triangle.

6. The crane game of claim 5, wherein the shape of the second deflection wall is a trapezoid.

7. The crane game of claim 6, wherein the first, second, and third deflection walls are arranged in such a way as to cause the prize deflector to be in the shape of a ramp.

8. The crane game of claim 1 wherein the prize is a bundle of tickets and wherein the value of the bundle of tickets is programed onto the RFID tag.

9. The crane game of claim 1, wherein the playing floor has no prize openings.

10. A crane game comprising:
- a game housing;
- an enclosed crane housing positioned within the game housing;
- a playing floor within the crane housing and wherein the playing floor has no prize openings;
- a crane house ceiling;
- a gantry attached to the crane house ceiling;
- a crane attached to the gantry;
- a claw mechanism attached to the crane;
- at least one prize on the game playing floor;
- an RFID tag attached to the at least one prize;
- a joystick, wherein the joystick is located on an external side of the game housing;
- an RFID reader;
- a prize deflector, wherein the prize deflector includes first, second, and third deflection walls;
- a base; and
- an internal housing unit supported on the playing floor and wherein the RFID reader is located within the internal housing.

11. The crane game of claim 10, wherein the shapes of the first and third deflection walls are identical and are in the shape of a triangle.

12. The crane game of claim 11, wherein the shape of the second deflection wall is a trapezoid.

13. The crane game of claim 12, wherein the first, second, and third deflection walls are arranged in such a way as to cause the prize deflector to be in the shape of a ramp.

14. A crane game comprising:

a game housing;

an enclosed crane housing positioned within the game housing;

a playing floor within the crane housing;

a crane house ceiling;

a gantry attached to the crane house ceiling;

a crane attached to the gantry;

a claw mechanism attached to the crane;

at least one prize on the game playing floor;

an RFID tag attached to the at least one prize;

a joystick wherein the joystick is located on an external side of the game housing;

an RFID reader;

a prize deflector, wherein the prize deflector includes first, second, and third deflection walls;

a base; and an internal housing unit supported on the playing floor and wherein the RFID reader is located within the internal housing.

* * * * *